US008528469B2

(12) United States Patent
Doglioni Majer

(10) Patent No.: US 8,528,469 B2
(45) Date of Patent: Sep. 10, 2013

(54) METHOD AND DEVICE FOR PRESERVATION OF PACKAGED BEVERAGE PREPARING PRODUCT

(75) Inventor: Luca Doglioni Majer, Carate Urio (IT)

(73) Assignee: Tuttoespresso S.p.A., Caronno Pertusella (IT)

( * ) Notice: Subject to any disclaimer, the term of this patent is extended or adjusted under 35 U.S.C. 154(b) by 970 days.

(21) Appl. No.: 12/439,537

(22) PCT Filed: Sep. 7, 2007

(86) PCT No.: PCT/IB2007/002573

§ 371 (c)(1), (2), (4) Date: Mar. 30, 2009

(87) PCT Pub. No.: WO2008/029265

PCT Pub. Date: Mar. 13, 2008

(65) Prior Publication Data

US 2010/0005973 A1 Jan. 14, 2010

(30) Foreign Application Priority Data

Sep. 7, 2006 (EP) ..... 06018767

(51) Int. Cl.
*A23L 1/00* (2006.01)

(52) U.S. Cl.
USPC ..... 99/467

(58) Field of Classification Search
USPC ..... 99/467, 472
See application file for complete search history.

(56) References Cited

U.S. PATENT DOCUMENTS 5,610,170 A * 3/1997 Inoue et al. ..... 514/340
5,916,615 A * 6/1999 Brady et al. ..... 426/129
6,102,198 A 8/2000 Merrell

FOREIGN PATENT DOCUMENTS

EP 0633013 A 1/1995

* cited by examiner

*Primary Examiner* — Raeann Gorden
(74) *Attorney, Agent, or Firm* — Oblon, Spivak, McClelland, Maier & Neustadt, L.L.P.

(57) ABSTRACT

A device for preserving a product for beverage preparation comprises a first container (4,4') having a first constant of oxygen permeability ($K^1PO_2$) wherein said product is sealed, that is housed in a second sealed package (5,5') having a second constant of oxygen permeability ($K^2PO_2$), the first constant of oxygen permeability ($K^1PO_2$) being greater than the second constant of oxygen permeability ($K^2PO_2$), moreover, an oxygen absorbing material (6) is housed in second container (5,5') together with the first container to remove oxygen from the first and second container (4,4').

10 Claims, 2 Drawing Sheets

METHOD AND DEVICE FOR PRESERVATION OF PACKAGED BEVERAGE PREPARING PRODUCT

BACKGROUND

The present invention relates to a method and a device for the preservation of packaged beverage preparing products, i.e. to a method and a device for preserving the aromas and organoleptic characteristics of a product in a capsule, cartridge, pod or similar disposable single-dose packaging means suitable for preparing beverages from automatic machines.

The use of disposable single-use plastic or paper packages such as cartridges, pods, capsules and the like, containing a product for preparing a beverage in an automatic machine, is known and widespread. The products for preparing beverages are in general ground or soluble coffee, tea, powder milk, herbal preparations and powder products for soups; these products are located within a container that is pod, capsule or cartridge that is intended to be inserted in a beverage preparing machine that brews or solubilize the product out of its container into a cup or similar beverage container. For clarity and conciseness, in the following description the word "capsules" will be used to identify also cartridges, pods and similar containers.

The use of these packages results in several advantages e.g. the tidiness of operation, the ability to achieve consistently the required quality of the end product (a.k.a. "quality in the cup") and a greater preservation from oxidation of the individual package with respect to the same product in a "bulk" container. In fact, coffee in a container, once open, will inevitably come into contact with ambient air; even if the container is re-sealed, contact with ambient air will be renovated with every withdrawal of a coffee dose from the container.

Recently, sealed packages became known. These packages are e.g. capsules sealed on both inlet and outlet: WO2006030461 in the name of the present applicant discloses such a capsule, that will be opened only when it has to be used for preparing the relevant beverage.

Packages that are not sealed, e.g. filter paper pods or traditional, open, plastic cartridges, are usually housed in an external container that is sealed to provide the required barrier to ambient air. It is quite important for both sealed and non-sealed capsules that ambient air and oxygen do not come into contact with the beverage product, e.g. ground coffee, especially because the time between packaging and consumption of the capsule can be relatively long.

It has been found that, when plastic packaging material is used, there always is a partial permeability of the sealing material to the ambient air oxidants. Aluminium laminated sheets provide a material that is substantially impermeable to oxygen; however, oxygen is usually found in capsules or containers, even in those containers that were packaged in an inert atmosphere, such as a nitrogen only atmosphere in a filling and packaging station under air-tight conditions.

US-A-20060144811 discloses a device for removing oxygen from a container of beverages or food that provides an oxygen absorber composition and an oxygen detector circuit on the inner wall of the closure member of the beverage or food container. The oxygen absorber composition is held in place, on the underside of the cap or closure member, by a cover layer of gas permeable film that prevents contact between the absorbent and the contents of the container; the oxygen detector generates a signal that provides an indication of the presence or absence of oxygen in the container. This device cannot be used in the present invention field because it requires a rigid container provided with a lid or closure member.

EP 0633013 discloses a method and a container for storing and stabilizing a powdered medicine containing bicarbonate. The medicine is packaged in a first container permeable to gas and water, that is housed in a second container non-permeable to gas and water. The second container is preferably filled with carbon dioxide and an oxygen scavenger is housed therein. This device relates to a different (i.e. medical) field and is designed to be used with single packages only, i.e. with packages wherein the second container is containing a single dose only. Such a package is of no use in the invention field because the medicine has to be removed from the first inner container and used immediately after opening the second, outer, container.

JP 2003 285876 (TOKAN KOGYO) discloses a package for meat and fish wherein the product is packaged in a first container impermeable to oxygen and wherein the first container is housed in a second container (also impermeable to oxygen) with an oxygen absorbing element. The aim and the teaching of this document is to avoid any chance of oxygen penetrating in the first container.

BRIEF SUMMARY

There is therefore the need to improve existing packages and containers for beverage products with respect to protection of said products from oxidation and from contact with oxygen. More particularly, the problem identified by the applicant and faced by the present invention is to remove the oxygen present in the capsules or other containers of the beverage products after they are produced and packaged in a bigger container, and to avoid or delay as much as possible that oxygen enters again into the capsules after the capsules (or similar containers of the products) are removed from the mentioned bigger container for preparing a beverage.

It is an aim of the present invention to solve the above mentioned problem and to provide a method and a device of preserving a product for beverage preparation that are effective, simple to prepare and easy to implement and that are not expensive, in order to be used in mass production of packaged capsules and/or other containers of beverage preparing products.

The above aim is achieved by means of the present invention that provides a method of preserving packaged products for preparing beverages, i.e. a method comprising the steps of housing said product in a first container (4,4') and housing at least one of said first container (4,4') in a second container (5,5') characterised in that said first container (4,4') is only partially permeable to oxygen and said second container (5,5') is less permeable to oxygen than said first container, and in removing oxygen from said first and second containers by means of an oxygen absorbing material (6) that is housed in said second container (5,5') together with said first container (4,4') while the at least one first container is housed in said second container.

It is a further object of the invention a device for preserving a product for beverage preparation, i.e. a device comprising a first container (4,4') wherein said product is housed, a second container (5,5') housing at least one first container, and an oxygen absorbing material (6) housed in said second container (5,5') together with said first container, characterised in that said first container (4,4') is only partially permeable to oxygen and said second container (5,5') is less permeable to oxygen than said first container, so as to remove oxygen from said first and second containers by means of said oxygen absorbing material (6) while the said at least one first container (4,4') is housed in said second container (5,5').

Preferred embodiments are the object of depending claims.

According to a preferred embodiment of the invention, the first container comprises a sealed capsule.

According to another aspect of the invention, the first container is a bag, housing a pod or a capsule, the constant of oxygen permeability of the material of the first container is within the range of 20 to 8000 and the constant of permeability to oxygen of the second, outer container, is within the range of 0 to 20. The two values, obviously, cannot be the same and preferably are at least 20 points different.

According to a further, preferred, aspect of the invention, the second container houses two or more, i.e. a plurality, of said first containers.

The present invention is based on the previously mentioned finding that some oxygen is always present in the sealed package of coffee, even if it is filled and packaged in a nitrogen protected atmosphere. In fact, measures of the oxygen content in sealed capsules carried out by the applicant have shown that capsules sealed in a nitrogen atmosphere, after subjecting them to vacuum, i.e. to a reduced pressure of 0.40-0.60 bar, have an average 1.4% (volume) oxygen content immediately after having been packaged.

Moreover, this percentage is going to increase with time, because the subsequent permeation of oxygen through the plastic capsule material is depending on the partial oxygen pressures within the capsule and outside the capsule and is independent on the total pressure within the capsule. To better explain this, it should be reminded that permeation can occur even if a container is pressurized, e.g. oxygen can permeate through the wall of a plastic bottle containing a carbonated beverage even if the internal total pressure is up to 5-10 times the ambient pressure, provided the oxygen partial pressure inside the bottle is sufficiently low. In practice, this fact results in an inevitable, even if more or less slow, permeation of the oxygen from ambient atmosphere through the capsule.

The present invention provides the dramatic advantage that, because of the presence of the oxygen absorbing material between first and second containers and because of the difference in permeability of the materials of the first and second containers, the oxygen present in the first container, e.g. the capsule, is removed from it because it permeates through the first container into the second container where it is absorbed by the oxygen absorbing material. At the same time, the zero or very low permeability to oxygen of the second container avoids or limits more oxygen to accumulate in the second container.

The oxygen concentration in the first container and in the second container (the outer container) is then kept at very low levels because any oxygen possibly entering the second container is scavenged and absorbed by the absorbing material. Preferably, the second container is bag made of a material with zero or very low permeability to oxygen, such as Al or EV-OH laminated films.

The first container is selected from a capsule, directly housing the product for the beverage, and a bag. The bag is usually housing a pod of filter paper or an open capsule, i.e. a device for containing the beverage product that is completely permeable to oxygen. It is a feature of the invention that the first container is not totally permeable to oxygen and that it is not substantially impermeable to oxygen, because the first container must provide a reduced permeation of oxygen into it after the second container is opened and the first container is exposed to ambient air.

Thus, the material of first and second containers is different and the Al or EV-OH laminated films cannot normally be used for the first container. For a sealed capsule, the material is a thermoplastic material with a thickness providing a capsule having a Gas Transmission Rate of oxygen within the range of 0.05 $cm^3$/day to 0.40 $cm^3$/day.

By means of the present invention it is possible to reduce the oxygen in the first container to a level as low as 0.1% and to maintain it for a period of up to a year in a package that is unexpensive and suitable to be commercialized. The level of 0.1% oxygen can be reached after only 4 days of permanence of the first container(s) in the second container. Moreover, once the second container is opened and the first container(s) are exposed to ambient air, the above mentioned partial permeability of the first container results in that it takes about 20 days to reach a concentration of oxygen inside the first container of 2%.

A further advantage of the invention is obtained when the second container is filled with $CO_2$ gas, usually in a purity range of 95 to 99% $CO_2$. In this case, because of the partial permeability of the material of the first container, and because permeability of $CO_2$ is always greater than permeability of $O_2$, two different and related processes will occur. Oxygen will be removed from the first container and $CO_2$ will enter into the first container because of the difference in the respective gas concentrations in first and second container.

If the beverage product is ground coffee, the step of providing a $CO_2$ atmosphere in the second container, was found to result in the unexpected advantage of a greater amount and better quality of the cream of an espresso coffee obtained from the capsule or pod after opening the second container.

BRIEF DESCRIPTION OF THE DRAWINGS

These advantages and the invention will be hereinafter discussed in greater detail with reference to the enclosed illustrative and non-limiting drawings, where.

DETAILED DESCRIPTION

Figure 1:
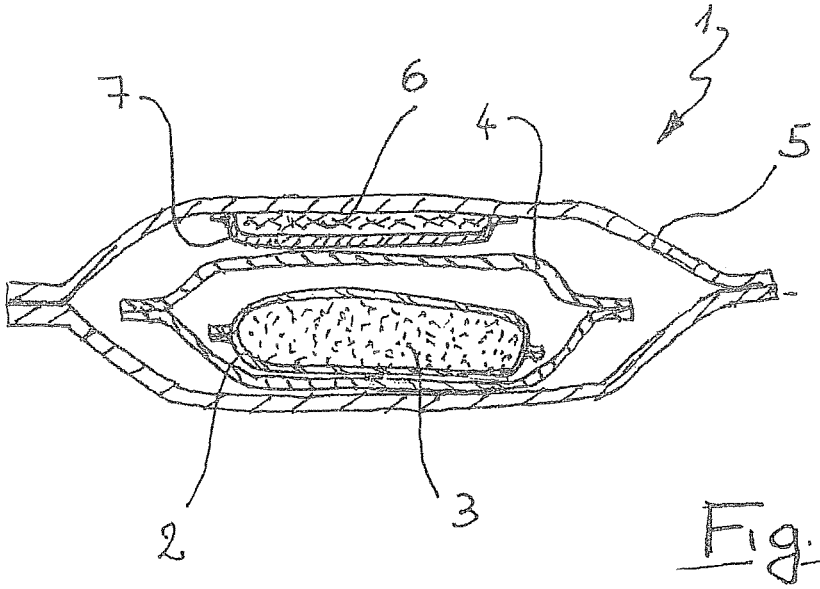
FIG. 1 is a schematic partially sectional view of a device according to the invention.

With reference to FIG. 1, the device according to the invention comprises a pod or similar container 2 in filter paper containing coffee or another product 3 for preparing a beverage in an automatic machine (not shown). The pod containing the preparation product 3 is housed in a first container 4 having a first constant of oxygen permeability $K^1P(O_2)$.

The constant of gas permeability KP is a value that defines the amount of gas the passes through a thickness unit of an area unit, in a time unit, under a unitary pressure difference:

$$KP=cm^3\ \mu m\ m^{-2} 24\ h^{-1}\ bar^{-1}$$

the above equation showing the cubic centimeters of a gas that passes through a square meter area of a material 1 micron thick in 24 hours with a gas pressure difference of 1 bar.

For the purpose of present invention, KP is referred to oxygen. The measure of KP can be carried out according to ASTM D1434 (in full ASTM 1434-88 D3985-02) and to this norm it is made reference in the following description.

The KP values mentioned in the present application, unless differently stated, will refer to films having a thickness of 25 μm.

The pod 2 containing product 3 is sealed in first container 4 (in the form of a bag) in a way known in the art. The filter paper 2 being totally permeable to gases, the permeation to be taken into consideration is the permeation through first container 4 only, that is dependent only on the type of material selected for first container 4. The used material will provide a bag, i.e. a first container having a Gas Transmission Rate of oxygen within the range of 0.05 $cm^3$/day to 0.40 $cm^3$/day; this applies to a first container in the form of a flat "bag" with a surface area within the range of 130 to 200 $cm^2$. The GTR range is thus from 0.25 $10^{-3}$ ml/day per square cm to 3.1 $10^{-3}$ ml/day per square cm.

In another embodiment of the invention, the ground coffee or other product 3 is directly housed by the first container 4, i.e. the filter paper or similar open container 2 is not present. This embodiment is suitable for preparing beverages from both manual machines such as moka or filtering machines and automatic machines that do not use capsules and that allow the use of loose ground coffee to be manually fed to the brewing chamber.

According to the invention, first container 4 is housed in a second sealed package 5 that has a second constant of oxygen permeability $K^2PO_2$ resulting in a zero or very low permeability to oxygen. The materials are selected so that the oxygen permeability of first container 4 is greater than the oxygen permeability of the second container 5.

Suitable materials for preparing first and second containers and their KP values at 25 μm (ASTM D1434) are listed hereinbelow:

| material | KP at 25 μm thickness |
|---|---|
| aluminium | 0 |
| EV-OH | 1-2 |
| polyamide 6 | 20-40 |
| PET | 45-90 |
| plasticized PVC | 2300-2700 |
| high density PE | 2800-3000 |
| PS | 3800-5400 |
| low density PE | 8000 |

Combinations of the above materials in the form of laminated materials are widely known and used; examples of such laminated materials are plastic materials coupled to aluminium, having a KP of about zero, and a plastic film 94 μm thick and made of two external layers of PP and one internal layer of EVOH (the EVOH layer being 10 μm thick) that has a KP of 1.47 (ASTM D1434).

The invention also provides for an oxygen absorbing material 6 to be housed in said second container 5 together with first container 4. As shown, the oxygen absorbing material is contained in a bag of oxygen permeable layer of plastic film 7 and adhered to package 5. In a preferred embodiment, the oxygen absorbing material 6 is contained in a pouch or bag of plastic film 7 that is freely housed in package 5, i.e. the bag 7 can be removed from the second container after the second container has been opened, to be stored e.g. in a closed box or similar container with the capsules and/or bags removed from the second container. Alternatively, the oxygen absorbing material 6 can be incorporated into the material of the first or second container.

Oxygen absorbent materials are known in the art, e.g. by the above mentioned US application US-A-20060144811, and widely used in the food processing industry. Suitable materials are cathecole, organometals, glucose oxidase, ethanol oxidase and ferrous ($Fe^{2+}$) compounds and their mixtures with other materials such as carbon based materials.

Figure 2:
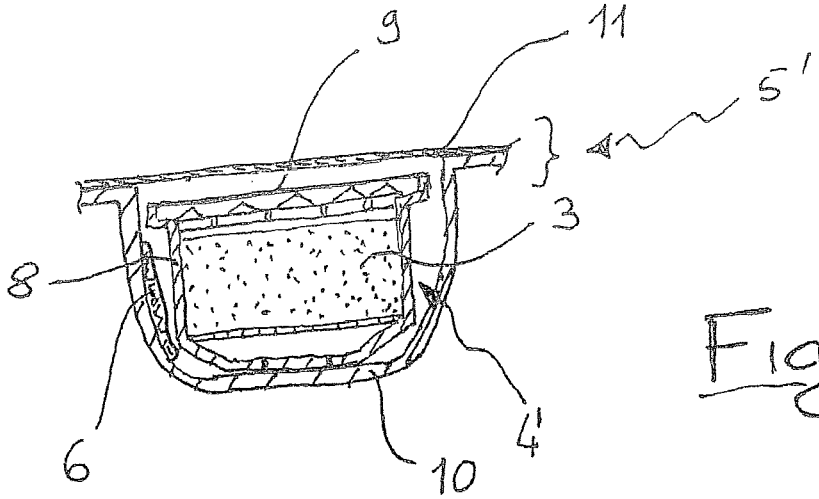
FIG. 2 is a schematic partially sectional view of another device according to the invention.

Another embodiment of the invention is shown in FIG. 2. In this embodiment, the first container 4' is consisting in a sealed capsule 8 having a body made of high density Polyethylene (HDPE) or Polypropylene (PP). The capsule comprises a sealing film 9 of plastic material laminated to aluminium and welded to the capsule 8 body. The shown capsule is disclosed in detail in application WO2006030461. Because of the difference in the KP values (laminated aluminium and plastic is substantially zero permeable), oxygen permeation will occur through the body 8 of the capsule. The sealed capsule is housed in a second container 5' that is comprising a plastic body 10 shaped to house the capsule and a sealing film 11 sealingly adhered to body 10. The shown combination of body 10 and film 11 provides an embodiment of a second container 5' of the invention; in a further, preferred, embodiment of the invention, the second container 5' is identical in shape and material to second container 5 shown in FIG. 1, i.e. it is in the form of a flat bag.

As previously mentioned, the oxygen permeation of first container 4', i.e. through the sealed capsule, is greater than the oxygen permeation of second container 5', i.e. of the permeation through the housing body 10 and the sealing film. This can be expressed in terms of Gas Transmission Rate (GTR) of oxygen. The sealed capsule 4' has a GTR within the range of 0.04 $cm^3$/day to 0.40 $cm^3$/day, preferably of 0.05 to 0.35 $cm^3$/day and most preferably of 0.08 to 0.3 $cm^3$/day; this applies to a capsule 4' having a top welded to partially permeable plastic body, the top being sealed by a welded laminated film including an Aluminium layer ($KPO_2$ is thus about 0), and having a surface area of the partially permeable body within the range of 30 to 50 $cm^2$; the volume of the capsule is within the range of 10 to 30 cc. The GTR range for the capsule is thus from $1\times10^{-3}$ ml/day per square cm to $13\times10^{-3}$ ml/day per square cm.

The second container has a GTR that is lower than 0.04 $cm^3$/day and preferably close to zero and a second constant of oxygen permeability $K^2PO_2$ resulting in a zero or very low permeability to oxygen, i.e. a permeability that is lower than the permeability of first container 4'. Preferably the second constant of oxygen permeability $K^2PO_2$ of the material of the second container 5 (as measured by above mentioned ASTM D1434) is in the range of 0 to 8.

Figure 3:
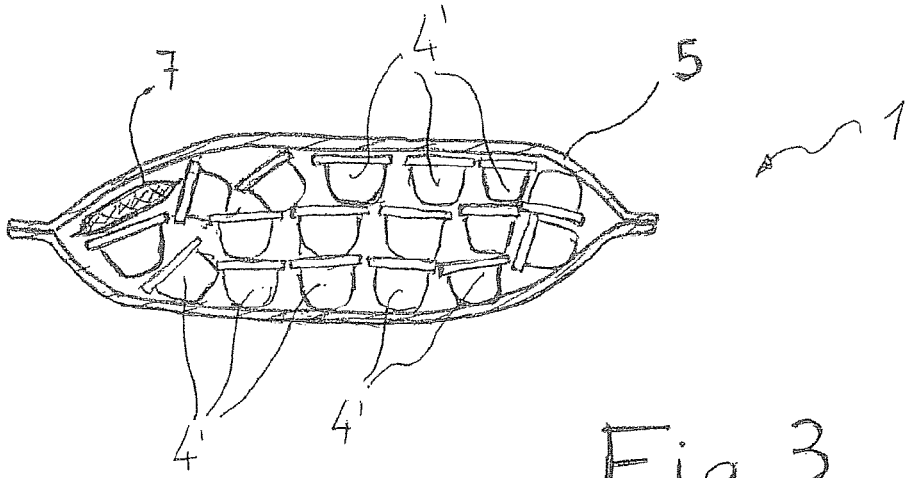
FIG. 3 and FIG. 4 are schematic views of preferred embodiments of the invention.
Figure 4:
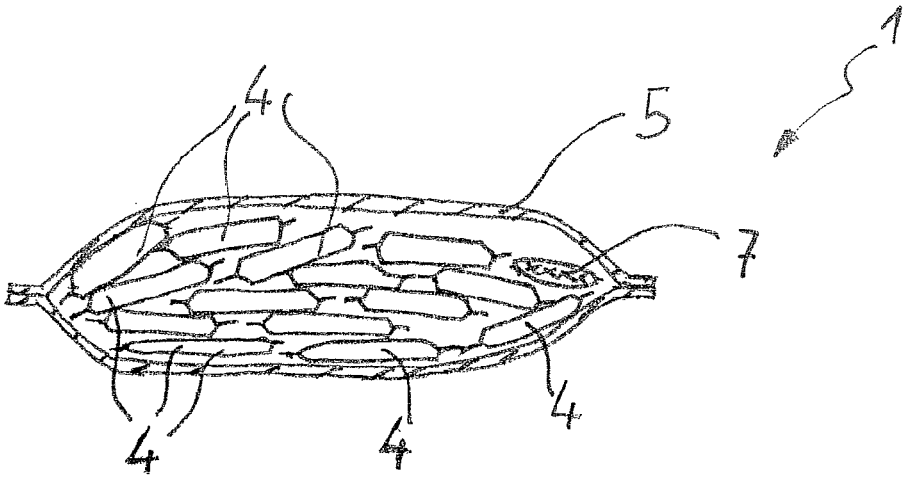

FIGS. 3 and 4 show a preferred embodiment of the invention. According to this embodiment, the second container 5 is housing a plurality of first containers 4' in FIG. 3 and of first containers 4 in FIG. 4. First containers 4' are sealed capsules as above disclosed with reference to FIG. 2, first containers 4 are the flat bags previously disclosed with reference to FIG. 1. The bags 4 can contain one or more (usually two) pods or open capsules, i.e. one or more product containers that are permeable to oxygen. Second container 5 is corresponding to the second container 5 above discussed with reference to FIG. 1, but is bigger so as to house a plurality of first containers 4 or 4', or a mix of them. A container 7 for the oxygen absorbing material 6 is housed in second container 5.

As in the previously discussed embodiments, first and second containers are sealed, i.e. the permeability depends on the materials and the GTR depends on materials and on surface areas of the containers.

The method according to the invention provides for the production of the above discussed device wherein the product to be preserved is contained in a first container 2, 2' that is in turn contained in a second container 5,5' together with the oxygen absorbing material 6.

Because of the presence of the oxygen absorbing material 6 between first and second containers and because of the above discussed difference in permeability of the materials of the first and second containers, the method provides for the oxygen present in the first container 2, 2', e.g. the capsule or in the pod-containing bag 4, to permeate through first container 2 or 2' into second container 5 or 5'. Here, the oxygen is removed from the second container because it is absorbed by the oxygen absorbing material 6.

Preferably the second container is filled with a modified atmosphere containing no or very little oxygen to help the oxygen absorbing material in its task. The gases used for this are usually selected from Nitrogen and $CO_2$.

The first container is thus kept clear of oxygen in that any oxygen entering the second container is scavenged and absorbed by the absorbing material 6 before it can permeate into first container 2, 2'.

The invention will now be further discussed with reference to the following non-limiting examples.

To determine the oxygen content of a capsule, the sealed capsule was fixed to the bottom of a container full of water at 20° C., and was submersed by the water. A beaker full of water was located over the capsule and the capsule perforated to let air flow out and be trapped into the beaker. The trapped air was analysed in a gas chromatograph having a TCD detector.

Oxygen content in second container was measured with a PBI Dansensor CheckMate 9900 analyser.

Example 1

Measure of the Oxygen Content of a Known Capsule 50 capsules made of high density PP, as shown in FIG. 2, were subjected to vacuum, i.e. a reducer pressure of 0.4 bar, flowed with nitrogen and sealed with PP/aluminium laminate film.

The average content of oxygen was found to be 1.41%.

Example 2

Production of the Invention Package 50 capsules obtained as per example 1, having an oxygen content of 1.4%, were sealed under nitrogen atmosphere, as above disclosed in example 1, in bags of PP/EVOH/PP having a $KPO_2$ of 1.47. Each bag contained 5 capsules and an oxygen absorbing element that was suitable to absorb 210 ml of $O_2$.

Measure of the oxygen content of the package.

The oxygen content of the outer package and of the capsule was measured every day. After four day the oxygen content in the second container and in the capsule was found to be 0.1%. This level was maintained for the following 3 months.

Example 3

Measure of the Oxygen Content of the Capsule after Opening the Second Container After reaching the oxygen content of 0.1% the capsules were left in ambient air. One capsule was tested every 24 hours to determine the oxygen increase. After 5 days the capsules had reached the oxygen content of 1.24% (v/v); an oxygen content of 2.0% (v/v) was reached after 20 days.

Example 4

Use of $CO_2$ as Filling Gas for the Second Container

The package is comprising a second container 5 and a plurality of sealed capsules forming first containers 4' as shown in FIG. 3. The capsules are produced according to example 1; 20 of such capsules are put in a second container 5 in the form of a bag made of the material disclosed in example 2. The bag has a volume of two liters and a surface area of 0.104 $m^2$. The bag is fed with $CO_2$ (Food grade, purity greater than 99%) in the filling step, to obtain a final content of $CO_2$ of at least 70% in volume, and preferably of 98% in volume. After one month the second container, i.e. the bag, was opened and the oxygen content of 10 of the capsules was measured to give an average result of 0.14% (in volume). The other 10 capsules were used to prepare espresso coffees that showed a greater and more consistent amount of cream with respect to 10 espresso coffees prepared from 10 capsules produced one week earlier and not subjected to the preservation method of the invention.

The above examples clearly show the surprising advantages obtained by means of the present invention. By using an appropriate permeability value (i.e. a value of $KPO_2$ or GTR) for the first and second container and an oxygen absorbing material in the second container, it is possible to obtain a capsule that will have reduced content of oxygen for very long periods. The use of $CO_2$ as a filling gas for the atmosphere of the second container enhances the preservation of the products and improves quality and quantity of the cream of the resulting espresso coffees. Thus, shelf-life of the packaged product is maximized and long-lasting flavour quality of the dispensed beverage is ensured.

The invention claimed is:

1. A method of preserving a product for beverage preparation, comprising:

housing said product in a first container, the first container is a sealed capsule with a Gas Transmission Rate of oxygen within a range from $1\times10^{-3}$ ml/day per $cm^2$ to $13\times10^{-3}$ ml/day per $cm^2$; and housing at least said first container in a second container, said first container being partially permeable to oxygen to delay the oxygen from entering into the capsule when the second container has been opened, and said second container being less permeable to oxygen than said first container; and removing oxygen from said first and second containers with an oxygen absorbing material that is housed in said second container together with said first container while the first container is housed in said second container.

2. The method according to claim 1, wherein said capsule has a gas transmission rate of oxygen within a range of 0.05 $cm^3$/day to 0.40 $cm^3$/day.

3. The method according to claim 1, wherein said second container is made of a material having a constant of oxygen permeability at 25 μm that is within a range of 0 to 20.

4. The method according to claim 1, further comprising modifying an atmosphere in said second container.

5. A device to preserve a product for beverage preparation, comprising:

a first container that houses said product, the first container is a sealed capsule with a Gas Transmission Rate of oxygen within a range from $1\times10^{-3}$ ml/day per $cm^2$ to $13\times10^{-3}$ ml/day per $cm^2$;

a second container that houses at least the first container; and an oxygen absorbing material housed in said second container together with said first container, wherein said first container is partially permeable to oxygen and said second container is less permeable to oxygen than said first container, so as to remove oxygen from said first and second containers by said oxygen absorbing material while said first container is housed in said second container and to delay the oxygen from entering into the capsule when the second container has been opened.

6. The device according to claim 5, wherein said capsule has a gas transmission rate of oxygen within a range of 0.05 $cm^3$/day to 0.40 $cm^3$/day.

7. The device according to claim 5, wherein said second container is made of a material having a constant of oxygen permeability at 25 μm that is within a range of 0 to 20.

8. The device according to claim 5, wherein a modified atmosphere is provided in said second container.

9. The device according to claim 8, wherein said modified atmosphere is a $CO_2$ atmosphere.

10. The device according to claim 5, wherein said second container houses two or more of said first containers.

* * * * *